United States Patent [19]

Gilb

[11] 4,192,118

[45] Mar. 11, 1980

[54] HOLDOWN FOR ATTACHING WOOD FRAMING MEMBERS TO CONCRETE FOUNDATIONS

[75] Inventor: Tyrell T. Gilb, Berkeley, Calif.

[73] Assignee: Simpson Manufacturing Co., Inc., San Leandro, Calif.

[21] Appl. No.: 969,222

[22] Filed: Dec. 13, 1978

[51] Int. Cl.[2] ..... E04B 1/38

[52] U.S. Cl. ..... 52/714

[58] Field of Search ..... 52/714, 715, 712, 370, 52/293

[56] References Cited

U.S. PATENT DOCUMENTS

| | | | |
|---|---|---|---|
| D. 224083 | 7/1972 | Gilb | D8/08 |
| 3,889,441 | 6/1975 | Fortine | 52/715 |
| 4,067,168 | 1/1978 | Thurner | 52/714 X |

*Primary Examiner*—James A. Leppink
*Assistant Examiner*—Carl D. Friedman
*Attorney, Agent, or Firm*—James R. Cypher

[57] ABSTRACT

A metal element for holding the wood wall frame members to the concrete building foundation to resist uplift and overturning forces due to earthquakes, hurricanes, tornadoes and other forces destructive to wood frame buildings.

The holdown consists of a back member formed with openings for receiving fastening members for attachment to a vertical wood frame member, side members attached to the back member extending substantially the entire length of the holdown, a seat member including an opening for receipt of an attachment member for attachment to a concrete foundation, and a pair of foot members extending below the seat member for resting upon a sill member.

9 Claims, 13 Drawing Figures

HOLDOWN FOR ATTACHING WOOD FRAMING MEMBERS TO CONCRETE FOUNDATIONS

BACKGROUND

In conventional wood frame building construction, a wood sill plate is attached to the top face of the foundation by a threaded bolt or a mud sill anchor such as Simpson Manufacturing Co., Inc.'s, U.S. Pat. No. 3,889,441. The wood wall studs are attached to the wood sill by toe nailing. This standard construction is still used throughout most of the United States. In areas subject to earthquake activity such as California or tornado activity in the midwest and hurricanes in the southeastern states, building codes have been inacted to require some further anchoring of the wood frame structure to the concrete foundation. The early holdowns were merely metal angles and gusset members. They were inadequate because they were designed for holding two wood members which assumed means of attachment generally equal in respect to the resisting and loading forces.

The first generation of holdown devices which were designed to respond to the needs of connecting two very dissimilar materials such as wood and concrete was an angular channel design consisting of a relatively long body with means provided for two or three bolts intended to be attached to a portion of the wood frame such as studs and with a seat element welded into the end of the device. A single hole was formed in the seat for receiving an attachment means therethrough such as a bolt or anchor embedded in the concrete foundation or floor slab.

In 1965, the Simpson Company of San Leandro, Calif., in response to a growing need for holdowns to meet the more restrictive building codes, brought out a line of devices for connecting wood structures to concrete foundations and slabs for the purpose of resisting uplift forces generated by earthquakes. A typical holdown first designed and manufactured by Simpson and still sold today is illustrated in FIG. 10. This device consisted of a back formed with two or three bolt holes and triangular sides. A seat member was welded to the sides and back and was formed with a bolt hole for receipt of the bolt embedded in the concrete. The seat member was elevated above the wood sill so that the code requirement of a distance of seven (7) times the diameter of the bolt between the end of the stud and the center line of the first bolt in the device could be achieved. The Simpson Company did not file for patent protection on the device illustrated in FIG. 10 and as a consequence they were copied and became the industry standard.

The first variation in the holdown illustrated in FIG. 10 was made about a year later and is shown in FIG. 11. The former angled channel section became one-sided and the seat element was formed integrally with the side member. This design variation was practical for the lighter models and is still made and sold today. No patent action was taken on this variation, and it also became the standard of the industry.

In 1972, Gilb was granted U.S. Pat. No. D. 224,083 on a holdown illustrated in FIG. 12. This design incorporated a spacer element which automatically provided the "seven bolt diameter" standoff distance and provided gusset support in the seat.

The prior art holdowns had the following problems and shortcomings:

1. All of the prior art devices present a wasteful excess use of materials in respect to the load functions performed.

2. The triangular channel section holdown of FIG. 10 by its nature, when viewed as a flat plane prohibits any possibility of economical progressive die manufacture and requires relatively primitive hand, shear, punch, and bend operations in its fabrication.

3. The fitting and 100% welding of the seat insert of the holdown of FIG. 10 is costly and requires hand-fitted miscellaneous iron operations.

4. The basic design of the prior art holdown of FIG. 10 presents substantial field installation problems. The side supports enclose most of the bolt heads or nuts and a socket wrench is required for installation. As carpenters, who normally are responsible for installing the devices, normally only carry conventional end wrenches it is necessary for them to carry an additional tool in their tool boxes. In some union jurisdictions, carpenters are not even permitted to carry a socket wrench and it is necessary to call in another union to install the holdowns.

5. The most serious problem with the prior art devices is the fact that the nature of their design causes an angular moment reaction with respect to the imposed loads. Solving this design problem requires thicker gauges which contribute to the general heaviness of the device. As shown in FIG. 11, in the prior art the anchor bolt is attached to the seat at a horizontal distance from the back of the device. Since no part of the holdown structure is below the seat for resisting moment forces, and there is an eccentric loading on the device, the entire device tends to rotate about a pivot point where the seat intersects the stud. The result of this eccentric loading is an angular withdrawal of the bolts in the wood in respect to the relatively fixed resistance imposed by the bolt embedded in the concrete. Building codes require a design safety factor of 3, but no matter how massive the device, a characteristic mode of failure is the splitting and destruction of the stud by the downward and angular movement of the stud bolts. The intended shear value of the bolts in wood is not properly used.

SUMMARY OF THE INVENTION

The holdown illustrated in the specification and drawings represents an invention which is a solution to not just one but all of the above itemized deficiencies inherent in the current state of the art holdowns.

The solution is based upon taking unused areas of material from the back, bending it forward into the seat element, bringing side elements of the back forward to provide a generally U-channel, but with material distributed in accordance with the load forces and with the entire device sized to provide the code required "seven bolt diameter" distance for installation. Since substantially all metal is working in the areas and in the direction of the forces involved, extremely high metal to load efficiency results thus resulting in about a 50% metal savings over the first generation type products. The required welding is self-jigged and is only about one third that required of the original products. The general configuration of the part, and more importantly the fact that all bends are in one direction, makes it possible to design the part for progressive die tooling.

A summary of advantages of the present invention over the prior art products is set forth below:

1. The holdown set forth in this disclosure can be manufactured for approximately 50% of the cost of the prior art holdowns. These savings are achieved by the reduction in material required, use of progressive die tooling fabrication procedures, and simpler and fewer welding steps.

2. Shipping and distributor stocking costs can be reduced by about 50% because of reduction in shipping weight and nested packing.

3. Installation is relatively fool proof. The device cannot be installed in any way except to provide the "seven bolt diameter distance" required by the building code. Checking by inspectors at the job site is equally simple since no measurements need be taken. Inspection can be accomplished by a quick visual survey.

4. The holdowns can be installed by carpenters with open end wrenches which they normally carry instead of socket wrenches not normally carried by them or permitted in some union jurisdictions.

5. The seat may be provided with an elongated opening permitting some adjustments in installation. This is made possible by the channeled seat.

6. In some holdowns, only two bolts are required into the wood instead of three as required by the prior art model due to the development of full single shear values and the elimination of the rotational problem of the prior art devices which caused the wood to fail prematurely.

DESCRIPTION OF THE PREFERRED EMBODIMENTS OF THE INVENTION

Figure 1:
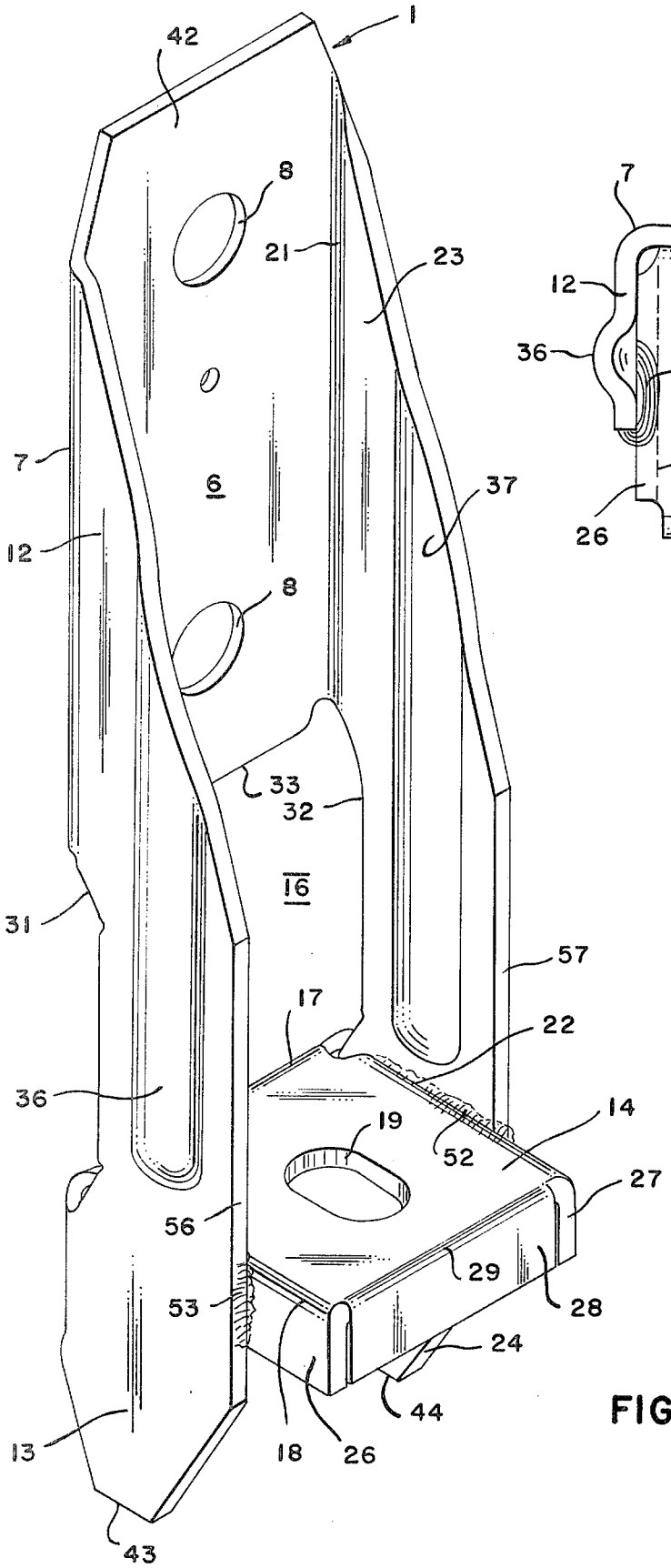
FIG. 1 is a perspective view of a holdown constructed in accordance with the present invention.
Figure 5:
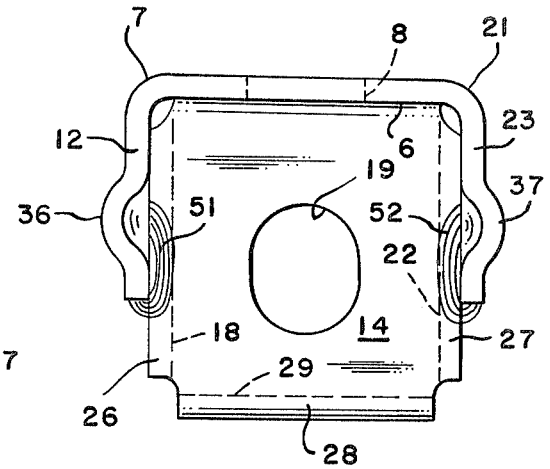
FIG. 5 is a top plan view of the holdown of FIG. 1.
Figure 2:
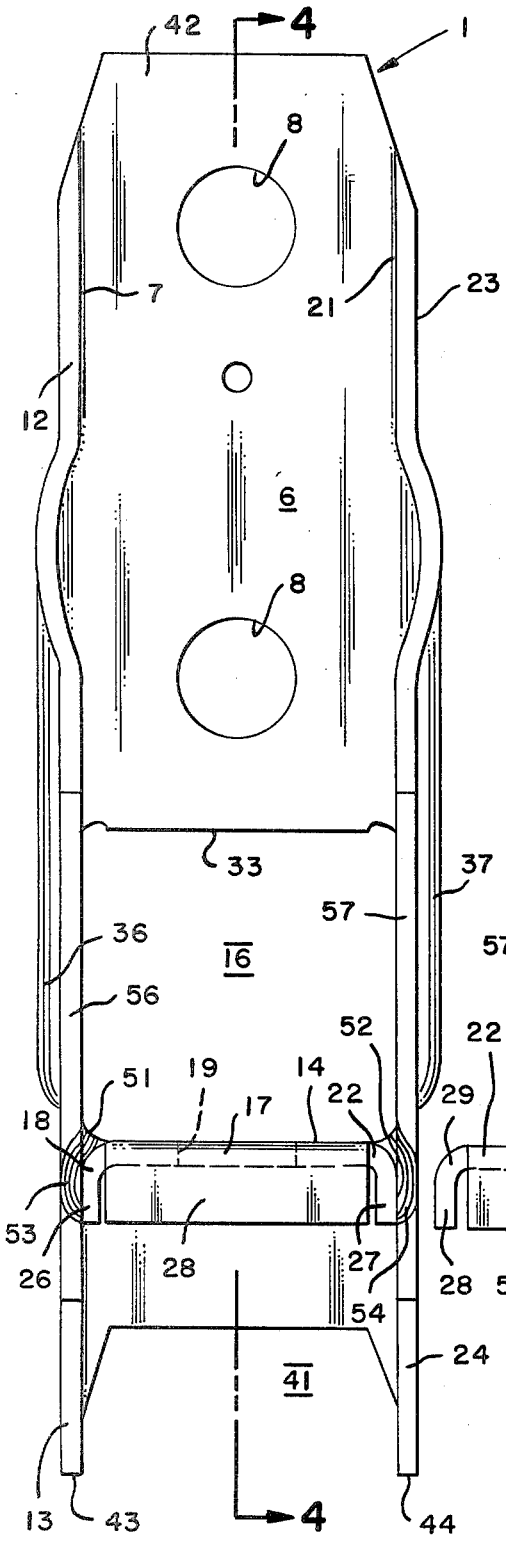
FIG. 2 is a front view of the holdown of FIG. 1.
Figure 3:
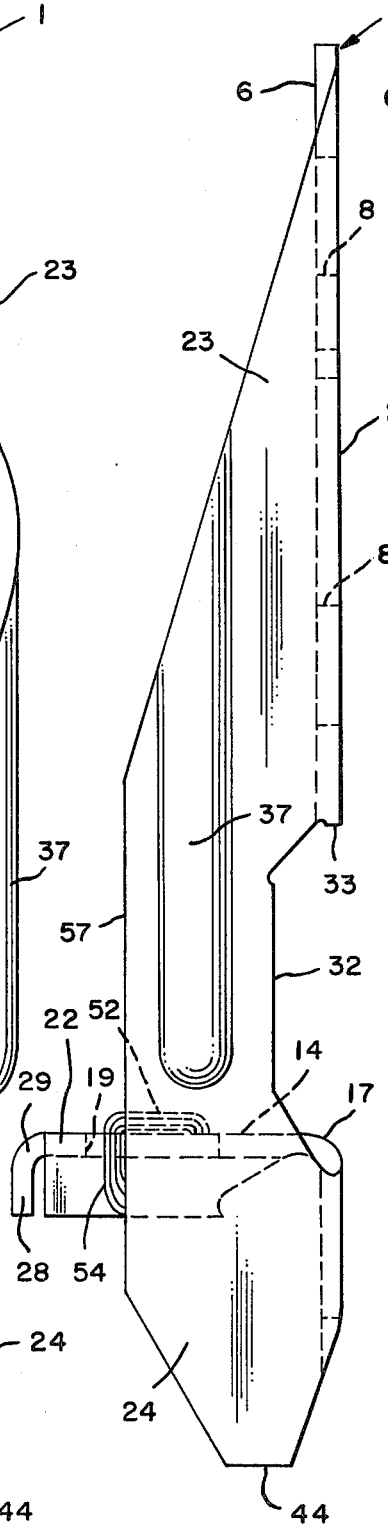
FIG. 3 is a side view of the holdown of FIGS. 1 and 2.
Figure 4:
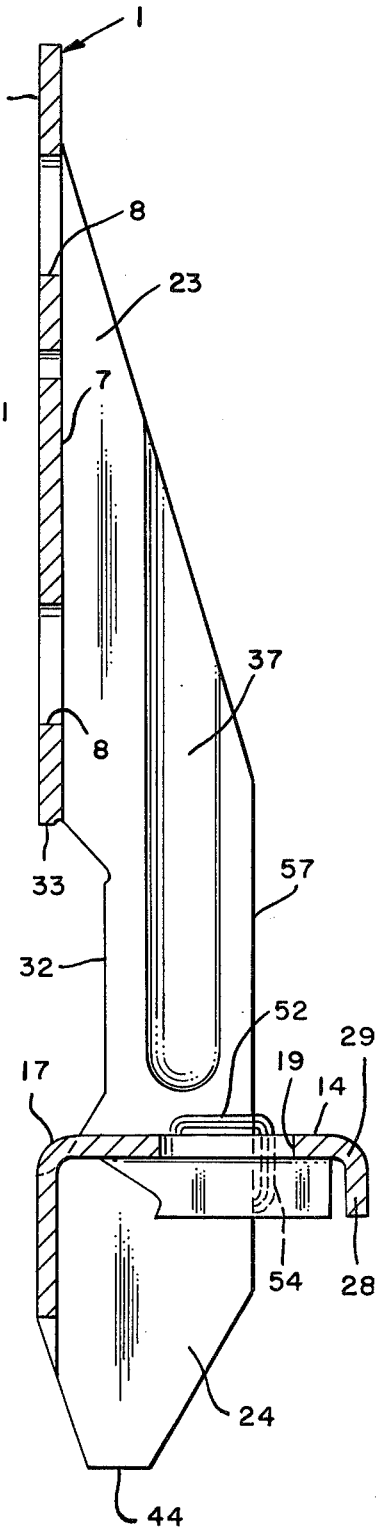
FIG. 4 is a cross section of the holdown taken along line 4—4 of FIG. 2.

The holdown 1 of the present invention for connecting wood frame members 2 to concrete foundations 3 or floor slabs provided with a sill member 4 consists of an elongated back member 6 having a first side edge 7 and formed with a plurality of longitudinally spaced openings 8 adapted for engagement with a face 9 of said wood frame member and adapted for attachment thereto by means of fasteners 11 inserted through said openings. A first side member 12 is integrally formed with the back member along the first side edge and is positioned substantially at a right angle thereto. A first leg member 13 is connected to the side member and extends downwardly therefrom and is adapted for resting upon the sill or foundation. A seat member 14 is formed from material removed from the back member as generally indicated by the opening 16. The seat has a back edge 17 connected to the back member and a first side edge 18 connected to the first side member. The seat is formed with a fastener opening 19 for insertion of a fastener 20 therethrough and adapted for attachment to the concrete foundation or floor slab.

Preferably, the seat member is integrally connected to the back member along a bend line at the back edge of the seat.

Referring to FIGS. 1–6, the back member is formed with a second edge 21 spaced from the first edge and substantially parallel thereto. The seat member is formed with a second side edge 22 spaced from the first side edge and substantially parallel thereto. A second side member 23 is integrally connected to the back member along the second edge. The second side edge of the seat member is connected to the second side member as by welding. A second leg member 24 is connected to the second side member and extends downwardly therefrom and is adapted for resting upon the sill or foundation. Preferably the second leg member is formed integrally with the second side member. The seat member is preferably formed with depending flanges 26 and 27 connected to the first and second edges. A front flange 28 may also be integrally formed with the seat and connected to the front of the seat along a bend line 29. Preferably the side seat flanges are integrally attached to the seat member along bend lines indicated by numbers 18 and 22. In the preferred form, the side flanges are formed from material removed from the side members as indicated by openings 31 and 32. The front flange of the seat is formed from material in the back member as indicated by opening 33.

The opening in the seat member may be elongated in shape in the direction normal to the back member, thereby providing some adjustment between the bolt 20 and the face 9 of the wall stud 2.

To provide greater rigidity in the side members, embossments 36 and 37 may be formed in each side member as indicated in FIGS. 1–6. The embossments are formed along a substantial portion of the side member above the seat member.

Figure 8:
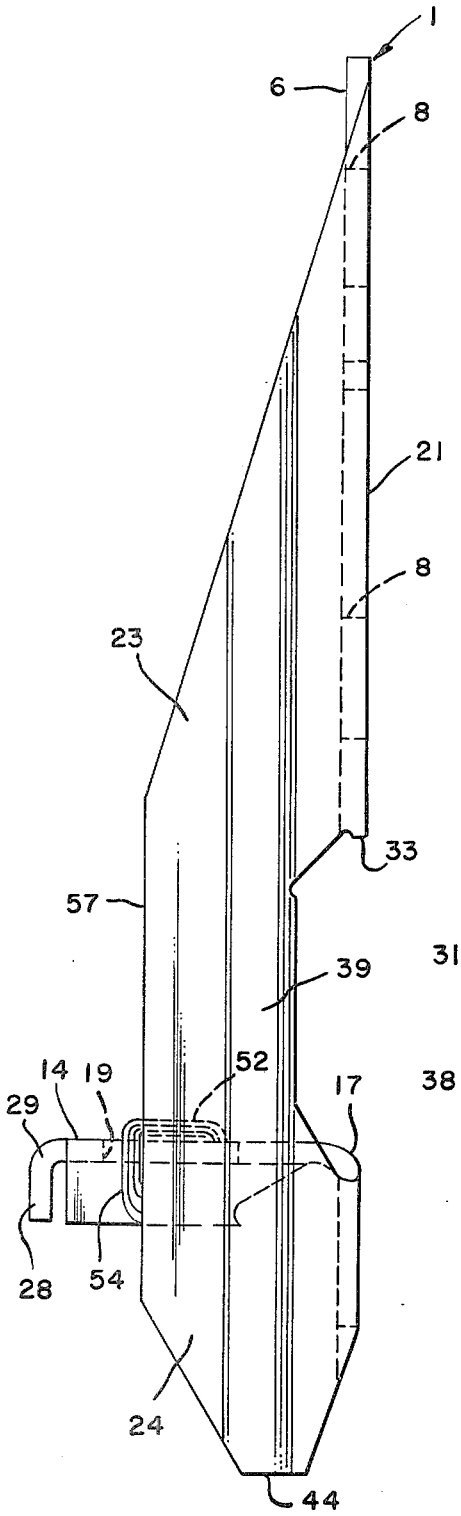
FIG. 8 is a side view of an alternate holdown in that embossment on the sides extends through the seat area.
Figure 9:
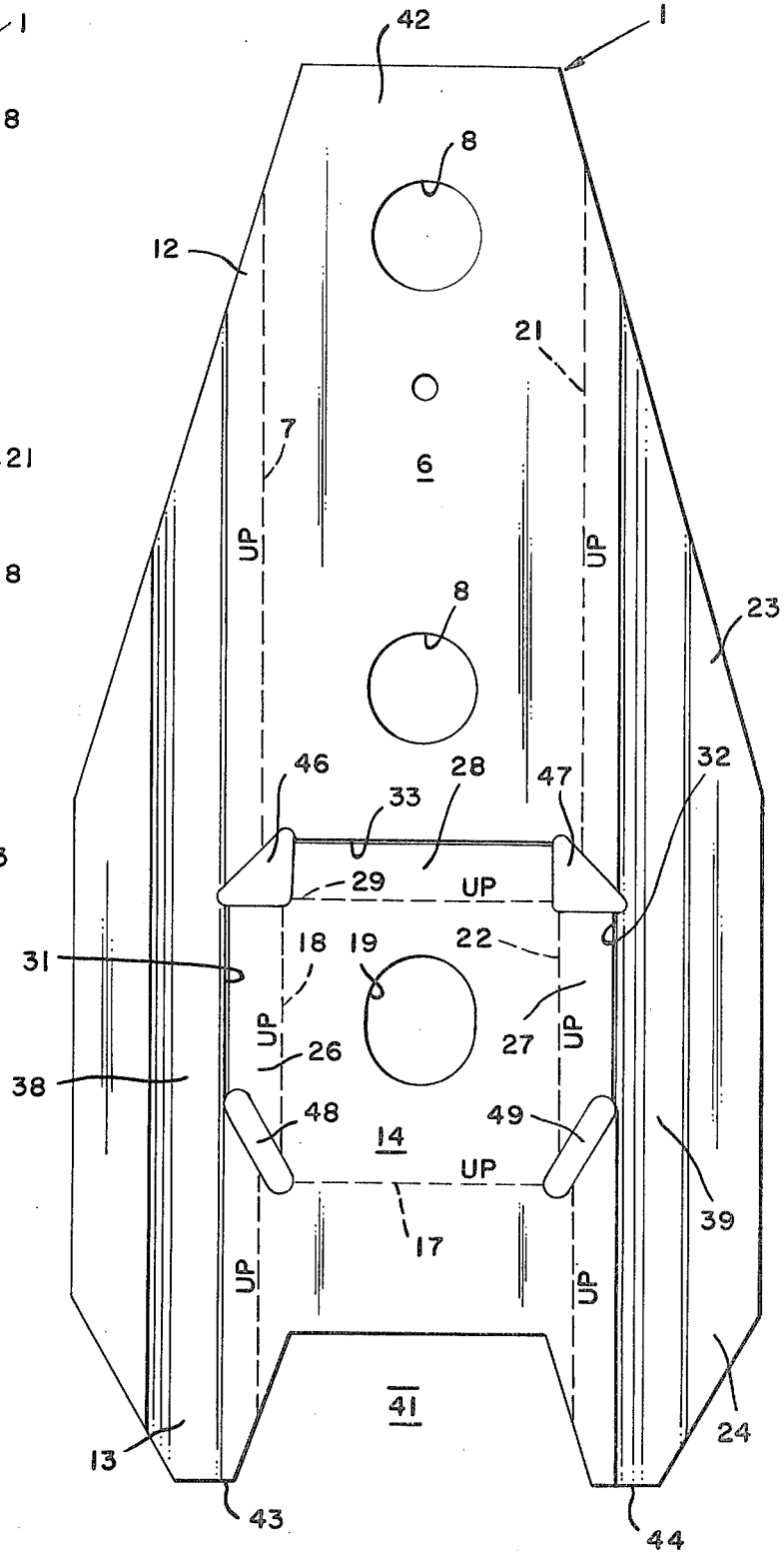
FIG. 9 is a plan view of the holdown of FIG. 8 prior to folding.
Figure 10:
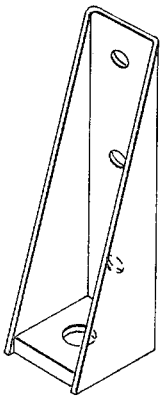
FIG. 10 (PRIOR ART)
FIG. 10 is a perspective view of prior art form of holdown introduced about 1965 and which is the present standard of the industry.
Figure 11:
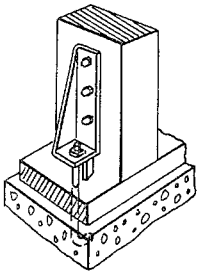
FIG. 11 (PRIOR ART)
FIG. 11 is another form of the prior art introduced about 1966; also a standard in the industry.
Figure 12:
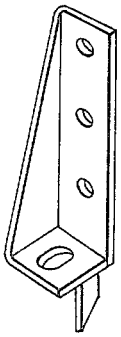
FIG. 12 (PRIOR ART)
FIG. 12 is a prior art device patented in 1972 and presently widely sold by Simpson Co. of San Leandro, Calif.
Figure 13:
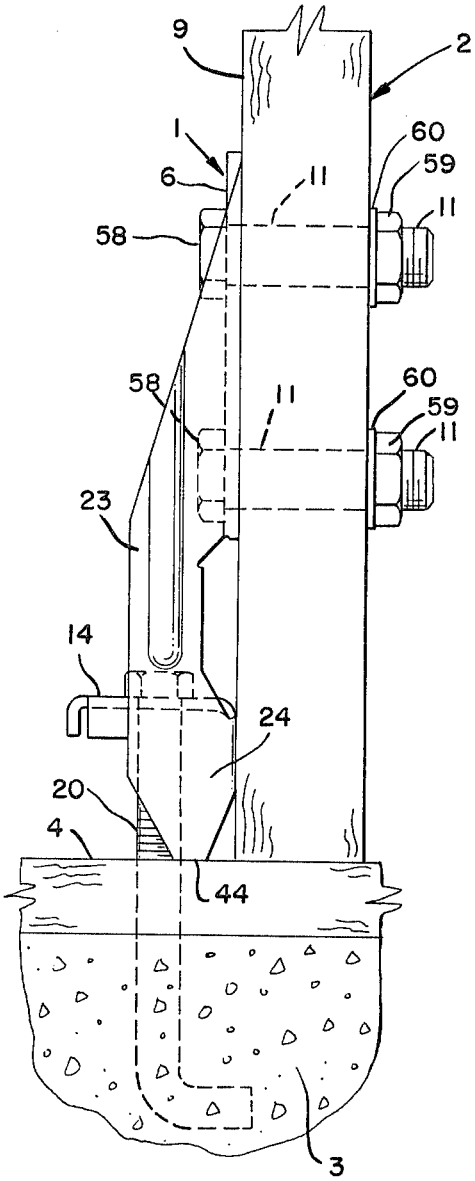
FIG. 13 is a side view of the holdown of FIG. 1 shown in a typical installation.

As shown in FIGS. 8 and 9, the embossments 38 and 39 extend substantially along the entire length of the side member and leg members including the area adjacent the seat member.

Figure 6:
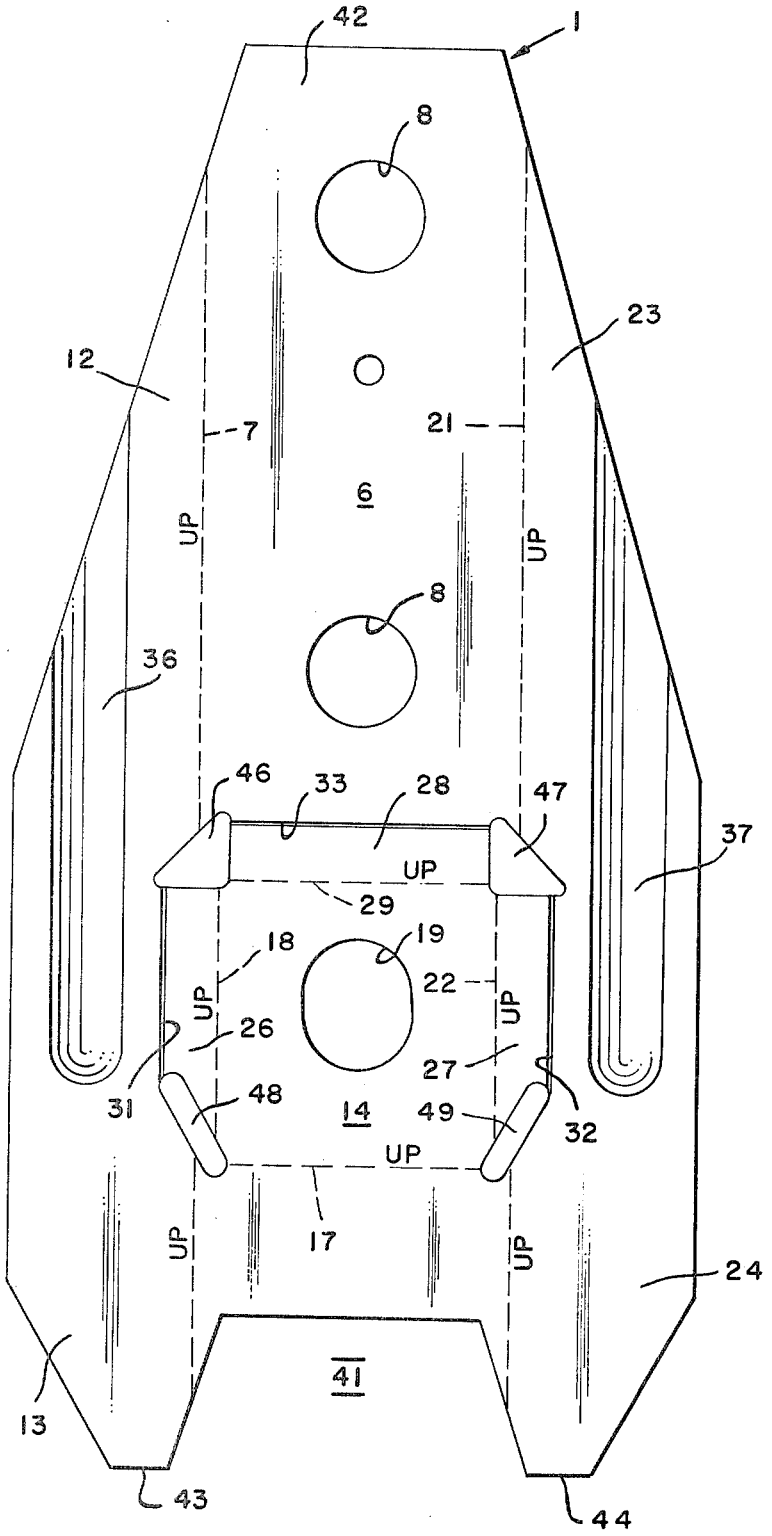
FIG. 6 is a plan view of the holdown of FIG. 1 prior to folding.
Figure 7:
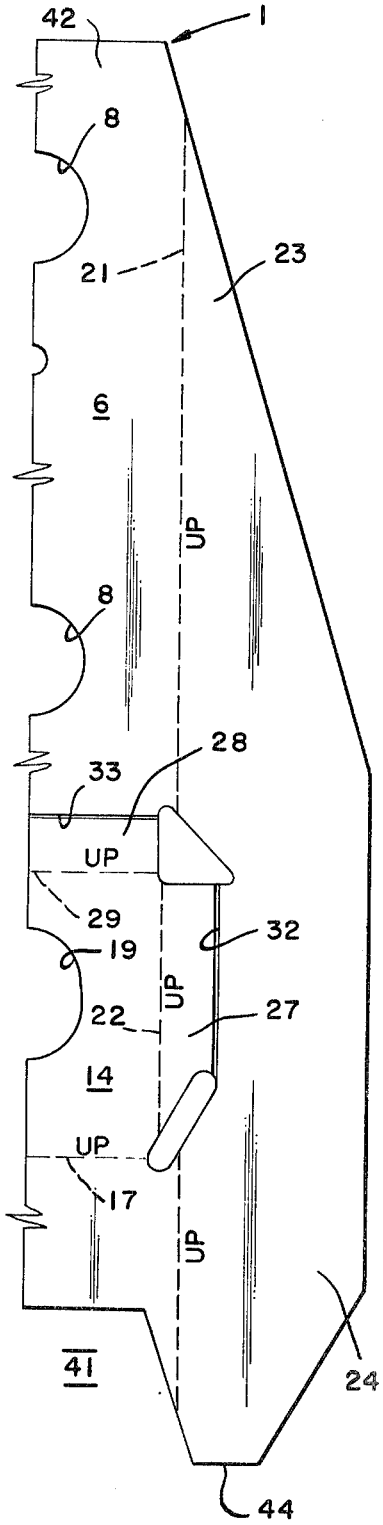
FIG. 7 is a partial view of an alternate form of the holdown prior to folding in that it is formed without embossment.

Preferably, the leg members extend beyond the back member. As shown in FIG. 6, for example, this configuration provides an opening 41 in the holdown member. It may be noted that the top portion 42 of the back member coincides with the area and shape of opening 41 so that the blank may be cut from a long strip of metal with a minimum of cuts and waste.

A primary feature of the present design is the fact that all bend line are in the "up" position as indicated on FIGS. 6 and 9 so that the holdown may be fabricated on progressive die tooling.

The ends 43 and 44 of the leg members are preferably shaped to form a blunt point so that the pointed portions will be forced into the wood so that the holdowns will not be suspended above the sill upon normal shrinkage of the wood.

Like numbers have been assigned to the modified forms of the invention where structure and function of the elements are identical. Metal thickness, size of openings and size and configuration of elements vary with the design forces to be met. In the present series of holdowns, gauge thickness varies from 7 gauge to 12 gauge and overall length varies from 7 to 12½ inches.

Construction of the holdowns is preferably from an elongated flat strip of metal although all parts could be cut from a blank and welded where bend lines are indicated in the drawings. Triangular cuts 46 and 47 are made in the blank to facilitate bending. Elongated cuts 48 and 49 with rounded ends are also made to facilitate bending. The sides and seat are then formed by bending along the dashed lines and in the direction indicated on the drawings. Embossments are made where indicated. Welds 51 and 52 are then made along the sides of the seat and the legs and at 53 and 54 along the side flange of the seat and edge 56 and 57 of the sides.

In operation, the holdown is set against a stud or other wood frame member with the points of the legs in contact with the wood sill member. The holdowns are placed at previously installed bolts imbedded in the concrete. The upper end of the bolt is inserted through the opening in the seat. Holes are drilled through the wood stud member 2 and bolts 11 with heads 58 are threaded ends for receiving nuts 59 and washers 60 are placed therethrough. A washer and nut is then placed on the threaded end of bolt 20 and a standard open end wrench tightens the nut until the points on the feet of the holdown are embedded in the wood a distance sufficiently to compensate for wood shrinkage.

In the present design, full shear value of the bolts 11 in the wood is developed because the holdown does not rotate about a point adjacent the seat as in the prior art designs. Even though the loads are applied eccentrically to the holdown, a substantial portion of the back member indicated by the number 6 remains in face contact with the lower end of the wood stud member. Further, the rigidity of the seat provided by the flanges and the three sided attachment to the back and sides of the holdown resists bending of the seat in relation to the back member. The point members in the foot are in contact with the sill member and further resist rotation of the holdown with respect to the wood stud member.

I claim:

1. A holdown for connecting wood frame members to concrete foundations comprising:

a. an elongated back member having a first side edge and a second edge spaced from said first edge and substantially parallel thereto and said back member is formed with a plurality of longitudinally spaced openings adapted for engagement with a face of said wood frame member and adapted for attachment thereto by means of fasteners inserted through said openings;

b. a first side member integrally formed with said back member along said first side edge and positioned substantially at a right angle thereto;

c. a first leg member connected to said side member and extending downwardly therefrom and adapted for resting upon said foundation;

d. a seat member formed from material removed from said back member and having a back edge connected to said back member and a first side edge connected to said side member, and formed with a fastener opening for insertion of a fastener therethrough adapted for attachment to said concrete foundation;

e. said seat member is formed with a second side edge spaced from said first side edge and substantially parallel thereto;

f. a second side member integrally connected to said back member along said second edge;

g. said second side edge of said seat member is connected to said second side member; and h. a second leg member connected to said side member and extending downwardly therefrom and adapted for resting upon said foundation.

2. A holdown as described in claim 1 comprising:

a. said seat member is formed with depending flanges connected to said first and second edges.

3. A holdown as described in claim 2 comprising:

a. said flanges are integrally attached to said seat member and formed from material removed from said side members.

4. A holdown as described in claim 3 comprising:

a. said opening in said seat member is elongated in shape in a direction normal to said back member.

5. A holdown as described in claim 1 comprising:

a. said side member is formed with an embossment running along a substantial portion thereof above said seat member.

6. A holdown as described in claim 5 comprising:

a. said embossment is formed in said side member including the area adjacent said seat member.

7. A holdown as described in claim 1 comprising:

a. said leg member extends beyond said back member.

8. A holdown as described in claim 1 comprising:

a. said seat member is integrally connected to said back member along a bend line at said back edge;

b. said seat member is formed with depending flanges connected to said first and second edges of said seat;

c. said seat flanges are integrally connected to said seat and formed from material removed from said side edges; and d. all of said fold lines are in the "up" direction so that said holdown may be fabricated using progressive die tooling.

9. A holdown as described in claim 1 comprising:

a. said seat member is integrally connected to said back member along a bend line at said back edge.

* * * * *